US005782038A

United States Patent [19]

Sponable et al.

[11] Patent Number: 5,782,038

[45] Date of Patent: Jul. 21, 1998

[54] WINDOW REGULATOR

[75] Inventors: Edward E. Sponable, Novi; Jeffrey Kolar, Livonia, both of Mich.

[73] Assignee: Hi-Lex Corporation, Battle Creek, Mich.

[21] Appl. No.: 688,248

[22] Filed: Jul. 29, 1996

[51] Int. Cl.[6] ..... E05F 11/48

[52] U.S. Cl. ..... 49/352; 49/349; 49/351

[58] Field of Search ..... 49/352, 348, 349, 49/350, 351, 374

[56] References Cited

U.S. PATENT DOCUMENTS

| | | |
|---|---|---|
| 3,143,340 | 8/1964 | Maslonka . |
| 4,353,185 | 10/1982 | Saigne . |
| 4,615,234 | 10/1986 | Chevance et al. . |
| 4,631,864 | 12/1986 | Barros . |
| 4,694,610 | 9/1987 | Hornivius . |
| 4,843,760 | 7/1989 | Hlousek . |
| 4,920,697 | 5/1990 | Vail et al. . |
| 4,924,627 | 5/1990 | Lam et al. . |
| 4,970,827 | 11/1990 | Djordjevic . |
| 4,991,351 | 2/1991 | Bertolini . |
| 5,038,519 | 8/1991 | Huebner . |
| 5,058,322 | 10/1991 | Sambor . |
| 5,074,077 | 12/1991 | Toyoshima et al. . |
| 5,309,679 | 5/1994 | Ward . |
| 5,333,411 | 8/1994 | Tschirschwitz et al. . |
| 5,359,811 | 11/1994 | Klippert . |

FOREIGN PATENT DOCUMENTS

| | | | |
|---|---|---|---|
| 529686 | 8/1956 | Canada | 49/349 |
| 2457955 | 1/1981 | France | 49/351 |
| 2325951 | 12/1973 | Germany | 49/351 |
| 2919882 | 12/1980 | Germany | 49/352 |
| 3438580 | 4/1986 | Germany | 49/352 |
| 0132285 | 5/1990 | Japan | 49/351 |
| 8500848 | 2/1985 | WIPO | 49/352 |

*Primary Examiner*—Peter M. Cuomo
*Assistant Examiner*—Hanh V. Tran
*Attorney, Agent, or Firm*—Young & Basile, P.C.

[57] ABSTRACT

A window regulator for raising a lowering a window pane in a motor vehicle. The regulator includes a scissors linkage including crossed lever arms connected at a pivot axis. The lever arms are attached at their upper ends to spaced points on the lower edge of the window pane and a cable is connected to the linkage at the pivot axis of the crossed arms. The cable is wrapped around a drum driven by a motor and is further trained over an upper pulley positioned above the pivot axis of the linkage and a lower pulley positioned below the pivot axis of the linkage. The regulator further includes a lower cross rail defining a rear pivot pivotally mounting the lower end of one of the lever arms, an intermediate pivot pivotally mounting the lower pulley, and a forward slot slidably mounting the lower end of the other lever arm.

The arrangement is such that movement of the cable through a first distance results in movement of the windowpane through a second distance greater than the first distance, thereby providing a speed multiplier effect.

15 Claims, 2 Drawing Sheets

12
14
22
24c
20
76a
76
64
70
70b
96
42a
70a
58
44
54
62b
62b
48b
42
62
62
44a
46a
32
62a
62a
92
66
50
68
78
80
60
84
24
24a
34
82
36
40
48
30
46
52
48a
46b
24b
40a
94
56
38
26

WINDOW REGULATOR

BACKGROUND OF THE INVENTION

This invention relates to window regulators and more particularly to window regulators for use in raising and lowering window panes in motor vehicles.

Motor vehicles include a plurality of window panes and a corresponding plurality of window regulators to raise and lower the window panes either manually or with a power assist. Whereas a myriad of window regulators have been proposed and/or utilized in raising and lowering the windows of motor vehicles, each of the prior art devices has suffered from one or more disadvantages.

Specifically, the prior art regulators have either been very complicated, relatively maintenance prone, relatively heavy, relatively large, and/or relatively slow in operation.

The complicated construction adds to the cost of manufacturer and assembly and thereby adds to the everincreasing cost of the associated motor vehicle; the maintenance problems exacerbate the problems of motor vehicle ownership; the relatively heavy aspect adds to the weight of the vehicle and thereby lowers the gas mileage of the vehicle; the relatively large aspect complicates the use of the regulator in the ever more narrow profiles of the doors of modern day motor vehicles; and the relatively slow operation results in a relatively long time to raise and lower the window pane.

SUMMARY OF THE INVENTION

This invention is directed to an improved window regulator especially suitable for motor vehicular use.

More particularly, this invention is directed to a window regulator that is simple in construction, inexpensive to manufacture and assemble, reliable in operation, lightweight, compact, and fast acting.

The window regulator of the invention is intended for use with a motor vehicle of the type including a window pane and a body structure including means for guiding the window pane for vertical movement between raised and lowered positions. The regulator is of the type including a cable assembly including a cable and cable drive means for moving the cable along a path, and means operative in response to movement of the cable to raise and lower the window pane. According to the invention, the operative means is operative in response to movement of the cable through a first distance along the path to move the window pane vertically through a second distance greater than the first distance. With this arrangement, a speed multiplier effect is achieved with the result that the window pane may be more quickly raised and lowered.

According to a further feature of the invention, the operative means comprises a linkage drivingly interposed between the cable and the window pane. This arrangement allow the linkage to be specifically configured to provide the speed multiplier effect.

According to a further feature of the invention, the linkage includes an upwardly angled lever arm mounted for pivotal movement about a lower end thereof and having attachment means at an upper end thereof to facilitate attachment of the upper end of the lever arm to the window pane, and the cable is connected to the lever arm at a location between the upper and lower ends of the lever arm. This specific arrangement provides a simple and effective means of providing the desired speed multiplier effect.

According to a further feature of the invention, the lever arm comprises a first lever arm and the linkage further includes a second upwardly angled lever arm arranged in a crossed, scissors relationship with respect to the first lever arm and pivotally connected to the first lever arm at a pivot axis, and the cable is connected to the first lever arm proximate the pivot axis. This specific arrangement retains the speed multiplier effect while providing a balanced, symmetrical lifting mechanism to minimize tilting of the window pane.

According to a further feature of the invention, the cable drive means includes a drum; the cable is endless and is wrapped around the drum; the cable drive means further includes a motor operative to drive the drum to wind in and pay out the cable to raise and lower the window pane; the cable assembly further includes upper and lower pulleys positioned above and below the pivot axis; and the cable is trained over the upper and lower pulleys. This specific arrangement provides a simple and efficient mechanism for driving the cable and thereby actuating the linkage.

In the disclosed embodiment of the invention, the attachment means at the upper end of the first lever arm comprises a window pane carrier adapted to be secured to a lower edge of the window pane and including a slot; the linkage includes a further window pane carrier at the upper end of the second lever arm adapted to be secured to the lower edge of the window pane and including a slot; the upper end of each lever arm is slidably received in a slot of the respective window pane carrier; the linkage further includes a lower cross rail including a slot and a pivot; the lower end of the first lever arm is slidably received in the cross rail slot; and the lower end of the second lever arm is pivotally secured to the cross rail pivot. This specific construction and arrangement provides a simple, inexpensive, reliable, lightweight, compact, and fast-acting regulator for use with a motor vehicle window pane.

DETAILED DESCRIPTION OF THE PREFERRED EMBODIMENT

Figure 1:
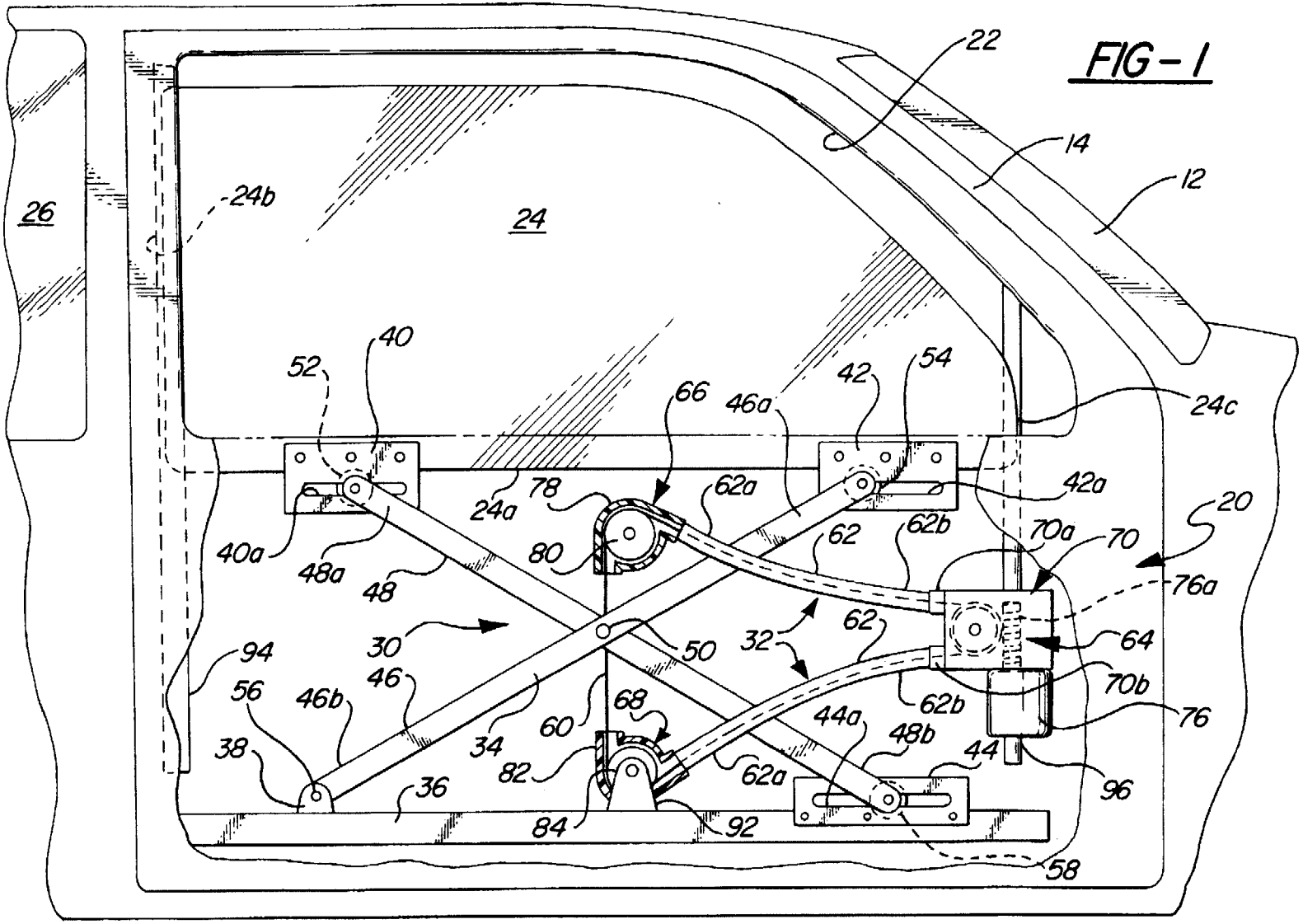
FIG. 1 is a fragmentary view of a motor vehicle employing a window regulator according to the invention.

The window regulator 10 of the invention is seen in FIG. 1 in association with a motor vehicle including a windshield 12, an A pillar 14, a sill 16, a B pillar 18, a right front door 20 with its outer skin **20*a* fragmentarily removed to illustrate the window regulator, a door window opening 22, a window pane 24, and a rear side window 26**.

Window regulator 10 is intended to move window pane 24 between raised and lowered positions relative to door window opening 22.

Window regulator 10, broadly considered, includes a linkage assembly 30 and a cable assembly 32.

Linkage assembly 30 includes a scissors linkage 34, a lower cross rail 36, a fixed pivot lug 38, window pane carriers 40 and 42, and a slide 44.

Figure 2:
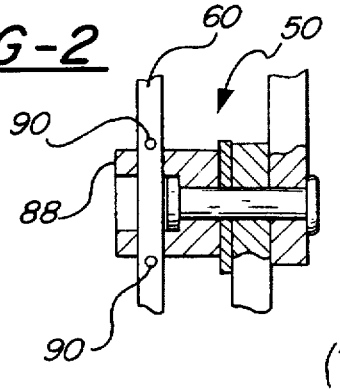
FIG. 2 is a detail view of a pivot axis assembly employed in the regulator.

Scissors linkage 34 includes lever arms 46 and 48 arranged in a crossed arm configuration and pivotally interconnected at their proximate midpoints by a pivot axis assembly 50 (FIG. 2).

Window pane carriers 40 and 42 are fixedly secured to the lower edge 24*a* of window pane 24 at respective forward and rearward locations along the lower edge 24*a*; pivot 38 is secured to a rearward location on cross rail 36; and slide 44 is secured to a forward location on cross rail 36. The upper end 48a of lever arm 48 carries a roller 52 which is slidably received in a slot or groove 40*a* defined in window pane carrier 40 beneath window pane lower edge 24*a*; the upper end 46*a* of lever arm 46 carries a roller 54 which is slidably received in a slot or groove 42*a* defined in window pane carrier 42 beneath window pane lower edge 24*a*; the lower end 46*b* of lever arm 46 is pivotally mounted on pivot 38 by a pivot pin 56; and the lower end 48b of lever arm 48 carries a roller 58 slidably received in a slot or groove 44*a* defined by slide 44.

Cable assembly 32 includes a cable 60, cable sheaths 62, a cable drive assembly 64, an upper pulley assembly 66, and a lower pulley assembly 68.

Figure 3:
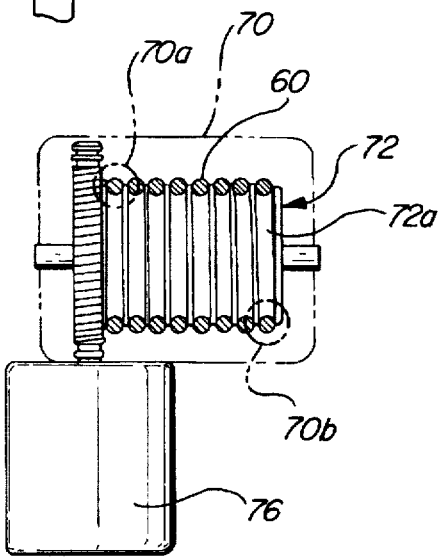
FIG. 3 is a detail view of a motor and drum assembly employed in the regulator.

Cable drive assembly 64 (FIG. 3) includes a housing 70, a drum 72 mounted for rotation within the housing and including a helically wound groove 72*a*, a gear 74 in driving relation with drum 72, and an electric motor 76 affixed to housing 70 and including an output shaft 76*a* drivingly engaging gear 74. Gear 74 and output shaft 76*a* may comprise a worm and a worm gear so that energization of motor 76 drives drum 72 in known manner.

Upper pulley assembly 66 includes a housing 78 and a pulley 80 mounted for rotation within the housing, and lower pulley assembly 68 includes a housing 82 and a pulley 84 mounted for rotation within the housing.

Linkage assembly 30 and cable assembly 32 will typically be provided to a motor vehicle manufacturer as a subassembly. In the subassembly 30/32, cable 60 is endless, is wrapped in helical fashion around drum 72 in helical groove 72*a*, is trained around upper and lower pulleys 80 and 84, and is fixedly secured to a swivel member 88 (FIG. 2) forming a part of pivot axis assembly 50 utilizing pins 90; pulley assembly 68 is mounted on a lug 92 provided on cross rail 36 between pivot lug 38 and slide 44; the lower end 46*b* of lever arm 46 is pivotally secured to pivot lug 38 for rotation about pivot pin 56; rollers 52, 54, and 58 are positioned respectively in grooves 40*a*, 42*a* and 44*a* of window pane carriers 40 and 42 and slide 44; and sheaths 62 are positioned in surrounding relation to cable 60 with the rearward ends 62*a* of the sheaths suitably received in socket portions 78*a*, 82*a* of pulley housings 78/82 and the forward ends 62*b* of the sheaths positioned in sockets 70*a* and 70*b* of cable drum assembly housing 70. It will be seen that sheaths 62 coact with cable 60 to define Bowden cable assemblies between the pulley housings 66/68 and the cable drive assembly housing 70.

Upon arrival at the motor vehicle manufacturer, the subassembly 30/32 is suitably mounted in the vehicle door 20. Specifically, window pane carriers 40 and 42 are fixedly secured to the lower edge 24*a* of window pane 24 with the rear edge 24*b* of the window pane slidably received in a rear vertical guide rail 94 positioned in the door and the front edge 24*c* of the window pane 24 slidably guided in a front vertical guide rail 96 positioned in the door; lower cross rail 36 is positioned within the door proximate the lower region of the door and is suitably fixedly secured to door structure; pulley housing 82 is suitably constrained against rotation; pulley assembly 66 is mounted on the door structure at a location above pivot axis assembly 50 with pulley housing 78 constraining against rotation; and cable drive assembly 64 is fixedly secured within the door at any location where space is available such for example, and as illustrated, in the forward region of the door.

When installed in the manner indicated, the linkage and cable subassembly 30/32 will be seen to be effective to raise and lower window pane 24 within window opening 22. Specifically, energization of motor 76 (as by an appropriate operator actuation of a control member positioned on the inner panel of the door) rotates drum 72 which pays out cable 60 from the drum and winds in a commensurate amount of cable 60 on the drum which has the effect of pulling upwardly or downwardly on pivot axis assembly 50, (depending on the direction of rotation of the motor) to raise or lower window pane 24.

As pivot axis assembly 50 is pulled upwardly or downwardly by the cable, lever arm 46 pivots at its lower end about pivot axis 56, roller 58 slides within slot 44*a*, and rollers 52 and 54 slide within slots 40*a* and 42*a*. Window pane 24 is seen in FIG. 1 in a partially raised position so that upward pulling movement of cable 60 on assembly 50 lifts the window pane to its final raised position completely closing door window opening 22 and downward pulling movement of cable 60 on assembly 50 progressively lowers the window pane to increase the window opening.

Figure 4:
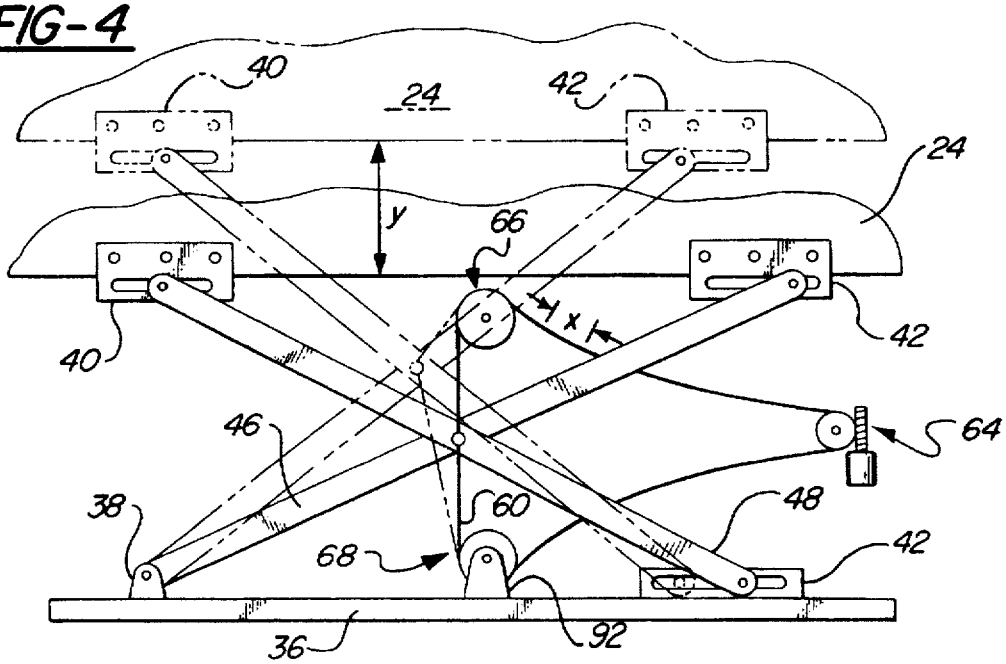

The up and down movement of the window pane is quick, positive and reliable. As best seen in FIG. 4, cable 60 is connected to lever arm 46 (or lever arm 48) at an intermediate point on the arm between the pivotally mounted lower end of the arm and the upper end of the arm attached to the window pane so that a given amount of linear movement of the cable has the effect of producing a greater amount of vertical movement of the window. Specifically, by virtue of the third class lever nature of the linkage, a linear movement X of the cable produces a much greater vertical movement Y of the window pane. Depending upon the parameters chosen, the ratio of Y over X may vary from 2.0 to 3.0. The vertical movement Y of the window pane relative to the linear movement X of the cable is illustrated by a comparison of the solid line and dash line regulator positions seen in FIG. 4.

Figure 5:
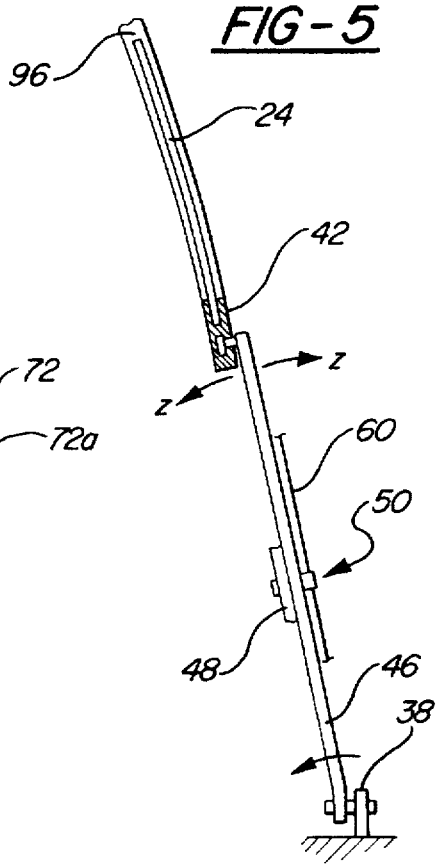
FIGS. 4 and 5 are schematic views illustrating aspects of the raising and lowering of the window pane by the regulator.

As seen in FIG. 5, the invention window regulator is also especially suitable for use with the curved side glass panes, and commensurately curved guide rails, that have recently become popular. Specifically, since the cable 60 does not constrain the linkage assembly in any significant way, the only constraint on the pivoting movement of the linkage assembly in a direction normal to the plane of the glass occurs at the lower end of the linkage assembly at the pivot 38 and at the slide 44. Accordingly, by providing appropriate tolerances at 38 and 44, the linkage assembly may be free to move or float, in the manner indicated by the arrows Z in FIG. 5, so as to allow the pane 24 to move freely up and down within the curved track provided by the rails 94 and 96, rather than providing the required float by fatigue inducing bending of metal parts as in prior art regulators.

The window regulator of the invention will be seen to provide many important advantages as compared to prior art regulators. Specifically, the third class lever nature of the linkage allows the window pane to be quickly moved to either its raised or its lowered position; the lack of constraint on the linkage allows the linkage to pivot about its lower ends so as to float in a manner to freely accommodate the curved tracks receiving the modern curved side glass; the freedom to position the pulley assemblies and the cable drive assembly in various locations within the door provides extreme versatility and allows the regulator to have essentially universal application to modern day vehicle doors; the regulator presents a very small package as compared to prior art regulators so as to fit readily in the ever more narrow profiles of the doors of modern day motor vehicles; the regulator incorporates fewer parts than most prior art regulators with consequent savings in manufacturing costs and assembly costs; the regulator allows the use of plastic parts where more expensive metal parts have previously been utilized; and the use of fewer, and plastic, parts reduces the regulator weight as much as 40% as compared to prior art regulators.

Whereas a preferred embodiment of the invention has been illustrated and described in detail, it will be apparent that various changes may be made in the disclosed embodiment without departing from the scope or spirit of the invention.

We claim:

1. A window regulator for use with a motor vehicle, the motor vehicle including a window pane and a body structure including means for guiding the window pane for vertical movement between raised and lowered positions, the regulator including a cable assembly including a cable and cable drive means for moving the cable along a path, and means operative in response to movement of the cable to raise and lower the window pane, the improvement wherein:

the operative means comprises a linkage drivingly interposed between the cable and the window pane;

the linkage includes a first upwardly angled lever arm mounted for pivotal movement about a lower end thereof and having attachment means at an upper end thereof to facilitate attachment of the upper lever arm to the window pane and a second upwardly angled lever arranged in a crossed, scissors relationship with respect to the first lever arm and pivotally connected to the first lever arm at a pivot axis; and the cable is connected to the lever arms at the pivot axis.

2. A regulator according to claim 1 wherein:

the cable drive means includes a drum; and the cable is endless and is wrapped around the drum.

3. A regulator according to claim 2 wherein the cable drive means further includes a motor operative to drive the drum to wind in and pay out the cable to raise and lower the window pane.

4. A regulator according to claim 3 wherein:

the cable assembly further includes upper and lower pulleys positioned above and below the pivot axis; and the cable is trained over the upper and lower pulleys.

5. A regulator according to claim 4 wherein:

the attachment means at the upper end of the first lever arm comprises a window pane carrier adapted to be secured to a lower edge of the window pane and including a slot;

the linkage includes a further window pane carrier at the upper end of the second lever arm adapted to be secured to the lower edge of the window pane and including a slot; and the upper end of each lever arm is slidably received in a slot of the respective window pane carrier.

6. A window regulator for use with a motor vehicle, the motor vehicle including a window pane and a body structure including means for guiding the window pane for movement between lowered and raised positions, the regulator including a cable assembly including a cable and cable drive means for moving the cable, and means operative in response to movement of the cable to raise and lower the window pane, the improvement wherein:

the operative means includes a linkage assembly drivingly connected to the window pane;

the cable is drivingly connected to the linkage assembly;

the linkage assembly includes a scissors linkage comprising two crossed arms connected at a pivot axis;

the cable is connected to the scissors linkage at the pivot axis; and the point of connection of the cable to the linkage assembly is free to move in a direction normal to the plane of the window pane.

7. A regulator according to claim 6 wherein:

the cable drive means includes a drum; and the cable is endless and is wrapped around the drum.

8. A regulator according to claim 7 wherein:

the cable drive means further includes a motor operative to drive the drum to wind in and pay out the cable to raise and lower the window pane.

9. A regulator according to claim 8 wherein:

the cable assembly further includes upper and lower pulleys positioned above and below the pivot axis; and the cable is trained over the upper and lower pulleys.

10. A regulator according to claim 9 wherein:

the linkage assembly further includes a pair of window pane carriers adapted to be secured to a lower edge of the window pane and each including a slot; and each arm includes an upper end slidably received in a slot of a respective window pane carrier.

11. A window regulator for use with a motor vehicle, the motor vehicle including a window pane and a body structure including means for guiding the window pane for vertical movement between raised and lowered positions, the regulator including a cable assembly including a cable and cable drive means for moving the cable along a path, and means operative in response to movement of the cable to raise and lower the window pane, the improvement wherein;

the operative means comprises a linkage drivingly interposed between the cable and the window pane;

the linkage includes a first upwardly angled lever arm mounted for pivotal movement about a lower end thereof and having attachment means at an upper end thereof to facilitate attachment of the upper lever arm to the window pane;

the cable is connected to the first lever arm at a location between the upper and lower ends of the first lever arm;

the linkage further includes a second upwardly angled lever arm arranged in a crossed, scissors relationship with respect to the first lever arm and pivotally connected to the first lever arm at a pivot axis;

the cable is connected to the lever arms proximate the pivot axis;

the cable drive means includes a drum;

the cable is endless and is wrapped around the drum;

the cable drive means further includes a motor operative to drive the drum to wind in and pay out the cable to raise and lower the window pane;

the cable assembly further includes upper and lower pulleys positioned above and below the pivot axis;

the cable is trained over the upper and lower pulleys;

the attachment means at the upper end of the first lever arm comprises a window pane carrier adapted to be secured to the lower edge of the window pane and including a slot;

the linkage includes a further window pane carrier at the upper end of the second lever arm adapted to be secured to the lower edge of the window pane and including a slot;

the upper end of each lever arm is slideably received in a slot of the respective window pane carrier;

the linkage further includes a lower cross rail including a slot and a pivot;

the lower end of the first lever arm is slidably received in the cross rail slot; and the lower end of the second lever arm is pivotally secured to the cross rail pivot.

12. A window regulator for use with a motor vehicle, the motor vehicle including a window pane and a body structure including means for guiding the window pane for movement between lowered and raised positions, the regulator including a cable assembly including a cable and cable drive means for moving the cable, and means operative in response to movement of the cable to raise and lower the window pane, the improvement wherein:

the operative means includes a linkage assembly drivingly connected to the window pane;

the cable is drivingly connected to the linkage assembly;

the linkage assembly includes a scissors linkage comprising two crossed arms connected at a pivot axis;

the cable is connected to the scissors linkage proximate the pivot axis;

the cable drive means includes a drum;

the cable is endless and is wrapped around the drum;

the cable drive means further includes a motor operative to drive the drum to wind in and pay out the cable to raise and lower the window pane;

the cable assembly further includes upper and lower pulleys positioned above and below the pivot axis;

the cable is trained over the upper and lower pulleys;

the linkage assembly further includes a pair of window pane carriers adapted to be secured to a lower edge of the window pane and each including a slot;

each arm includes an upper end slidably received in a slot of a respective window pane carrier;

the linkage assembly further includes a lower cross rail including a slot and a pivot;

one of the arms includes a lower end slidably received in the cross rail; and the other arm includes a lower end pivotally secured to the cross rail pivot.

13. A regulator according to claim 12 wherein the lower pulley is mounted on the lower cross rail between the cross rail pivot and the cross rail slot.

14. A window regulator mechanism for use with a motor vehicle and operative to raise and lower a window pane positioned in a window opening of the vehicle, the regulator including:

a cable assembly including a cable and cable drive means for moving the cable; and a linkage assembly drivingly connected to the cable, adapted to be connected to a lower edge of the window pane, and operative in response to movement of the cable to raise and lower the window pane;

the linkage assembly including a scissors linkage comprising two crossed arms connected to a pivot axis;

the cable being connected to the scissors linkage proximate the pivot axis;

the cable drive means including a drum;

the cable being endless and being wrapped around the drum;

the cable drive means further including a motor operative to drive the drum to wind in and pay out the cable to raise and lower the window pane;

the cable assembly further including upper and lower pulleys adapted to be positioned above and below the pivot axis;

the cable being trained over the upper and lower pulleys;

the linkage assembly further including a pair of window pane carriers adapted to be secured to a lower edge of the window pane and each including a slot;

each arm including an upper end slideably received in a slot of a respective window pane carrier;

the linkage assembly further including a lower cross rail including a slot and a pivot;

one of the arms including a lower end slideably received in the cross rail slot; and the other arm including a lower end pivotaly secured to the cross rail pivot.

15. A window regulator mechanism according to claim 14 wherein the lower pulley is mounted on the lower cross rail between the lower cross rail pivot and the lower cross rail slot.

* * * * *